United States Patent [19]

Labelle

[11] 4,434,525

[45] Mar. 6, 1984

[54] HINGE HAVING OPEN CURVED PORTIONS

[75] Inventor: Henri M. R. Labelle, Cornwall, Canada

[73] Assignee: Martinray Industries Ltd., Cornwall, Canada

[21] Appl. No.: 364,312

[22] Filed: Apr. 1, 1982

Related U.S. Application Data

[63] Continuation-in-part of Ser. No. 141,277, Apr. 18, 1980, abandoned, which is a continuation-in-part of Ser. No. 917,154, Jun. 20, 1978, abandoned.

[51] Int. Cl.[3] ..... E05D 1/04

[52] U.S. Cl. ..... 16/355; 16/374; 16/DIG. 29

[58] Field of Search ..... 16/355, 356, 374, DIG. 29

[56] References Cited

U.S. PATENT DOCUMENTS

| | | | |
|---|---|---|---|
| 2,641,018 | 6/1953 | Snyder | 16/356 |
| 2,852,802 | 9/1958 | Seby | 16/356 |
| 3,359,594 | 12/1967 | Pastoor | 16/356 |
| 3,423,787 | 1/1969 | Horstman | 16/356 |

*Primary Examiner*—Fred A. Silverberg
*Attorney, Agent, or Firm*—Jack Paavila

[57] ABSTRACT

A hinge having first and second elongated hinge members. The two hinge members rotate one within the other between open and closed positions. The hinge members are constructed to avoid any longitudinal gaps between the hinge members in either the open or closed positions.

9 Claims, 7 Drawing Figures

HINGE HAVING OPEN CURVED PORTIONS

CROSS-REFERENCE TO RELATED APPLICATIONS

This application is a continuation-in-part of U.S. application Ser. No. 141,277 filed Apr. 18, 1980, now abandoned, which application was a continuation-in-part of U.S. application Ser. No. 917,154 filed June 20, 1978, now abandoned.

BACKGROUND OF THE INVENTION

1. Field of the Invention

This invention is directed toward an improved hinge.

The invention is more particularly directed toward an improved hinge of the type comprising elongate, concentric part-circular hinge elements.

The invention is also directed toward a folding closure employing the improved hinge.

2. Description of the Prior Art

Hinges having concentric circular hinge elements are well suited for use in folding closures. The hinges provide weather-proof joints between adjacent closure panels and also normally provide smooth, reliable pivoting action at all stages of opening and closing. In addition, the part circular hinge elements make it easy to assemble the hinges by sliding one hinge element partly within the other. A separate pintle is not normally required to assemble the hinges. Hinges of the above type are quite well known as shown for example in applicant's U.S. Pat. No. 3,359,594.

The known hinges have some disadvantages however. Their construction is often such that narrow, longitudinal gaps extend between portions of the hinge elements when the closure is in the folded or unfolded positions. Because of the gaps, the hinges do not have a neat, clean appearance. More importantly, objects can be inserted into these gaps preventing functioning of the hinges, and thereby preventing operation of the closure.

The known hinges also have hinge elements with exposed edges, particularly when the closure is in an unfolded, operative position. The exposed edges often do not align adjacent hinge elements thereby again presenting an appearance problem. In addition, the exposed edges can invite tampering with the closure.

Another disadvantage of known hinges is that they occasionally have difficulty in functioning properly if they become even slightly misaligned. Elements in one hinge member can interfere with elements in the other hinge member if they become misaligned as the hinge members rotate between open and closed positions. The interference can hinder proper operation of the hinge.

SUMMARY OF THE INVENTION

It is therefore a purpose of the present invention to provide a hinge having concentric part-circular elements which hinge has a neater, cleaner appearance than known hinges. It is a further purpose of the present invention to provide a hinge which is less prone to vandalizing and tampering than known hinges.

It is another purpose of the present invention to provide an improved hinge which is easy to manufacture and assemble.

It is yet a further purpose of the present invention to provide a hinge which is constructed to minimize interference between the hinge members as they move between open and closed positions. It is also another purpose of the present invention to provide a hinge which is strengthened in both the open and closed positions.

In accordance with the present invention a hinge member is provided having hinge elements which cooperate to overlap each other externally at all times so as to eliminate gaps in the hinge structure.

The invention further provides a hinge in which some elements in the hinge members also overlap internally so as to provide smooth operation of the hinge, with a minimum of interference, during open and closing of the hinge. The increased external and internal overlap of the hinge elements also serves to provide a stronger hinge in both the open and closed positions.

The present invention also provides a hinge member having a minimum number of free or exposed edges to both improve the appearance of the hinge and to minimize tampering with the hinge. The above improvements are provided while retaining or improving the ease of manufacture and assembly of the hinge elements.

The invention is particularly directed toward a hinge having first and second elongated hinge members. The first hinge member has a base portion and a curved guide spaced from one side of the base portion. A long, curved first arm extends from the one side of the base portion in one direction about the guide and is concentric therewith. A web, spaced inwardly from the free end of the first arm, connects the pintle to the first arm. A short, curved second arm extends from the one side of the base in an opposite direction to the first arm. The second hinge member also has a base portion with a long, curved third arm extending from one side of the base portion in one direction and a long, curved fourth arm extending from the one side in an opposite direction to the third arm. The third and fourth arms curve toward each other, and have a gap between their free ends. The first and second hinge members slidably interconnect with the guide located within the fourth arm, the fourth arm located within the first and second arms and the first arm located within the third arm. With the interconnected hinge members in a closed position and the base portions located on the same side of the guide, the third arm overlaps the first arm. With the interconnected hinge members in an open position and the base portions generally located on opposite sides of the guide, the second arm overlaps the fourth arm.

The first base position includes a slot for receiving the free end of the fourth arm when the hinge members are in an open position.

The second base portion includes a slot for receiving the free end of the second arm when the hinge members are in a closed position.

The second hinge member includes a short, curved fifth arm which extends from the one side of the base portion inside of the third arm and concentric with it. The fifth arm forms an extension of the fourth arm. The fifth arm overlies one end of the pintle when the hinge members are in a closed position. The slot formed between the third and fifth arms receives the free end of the first arm when the hinge members are in an open position.

DESCRIPTION OF THE PREFERRED EMBODIMENTS

Figure 1:
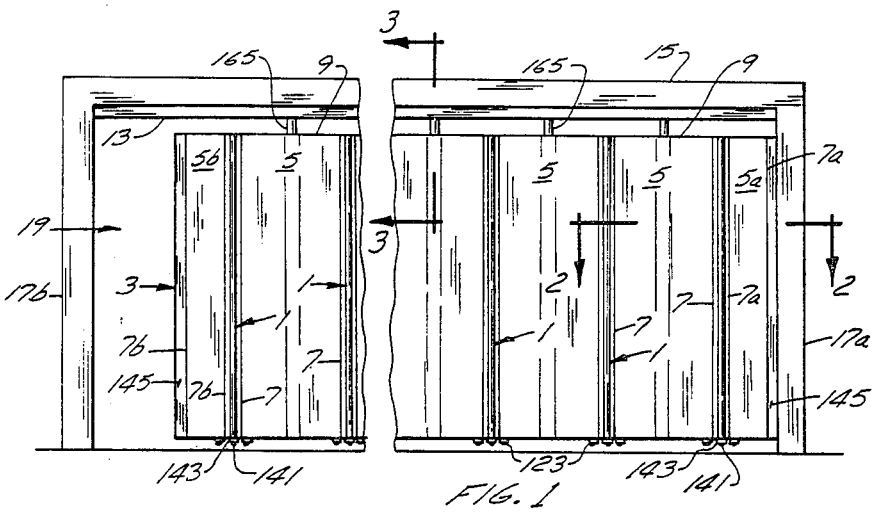
FIG. 1 is an elevation view of a closure employing the novel hinge.
Figure 3:
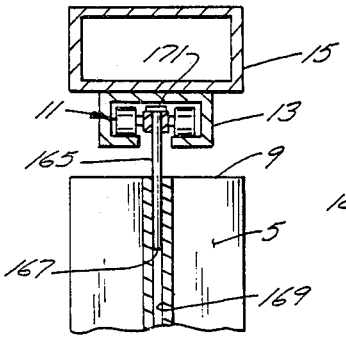
FIG. 3 is a cross-sectional view of the closure taken along line 3—3 of FIG. 1.

The hinge 1 of the present invention is particularly suited for use in folding closures 3. The folding closures 3, as shown in FIG. 1, are of the type comprising a plurality of full-sized elongated, rectangular panels 5 and two half-size elongated rectangular panels 5*a*, 5*b*. All the panels 5 are pivotably joined together with the hinges 1 along their long sides 7. Panel 5*a* is pivotably joined to one end of panels 5 by a hinge 1 along one of its long sides 7*a*, and panel 5*b* is pivotably joined to the other end of joined panels along one of its long sides 7*b* by a hinge 1. The hinged panels 5 are each pivotably suspended from the center of their top edge 9, from a trolley 11 running on a track 13 mounted on a top frame member 15, as shown in FIG. 3. Top frame member 15, together with side frame members 17*a*, 17*b*, define the rectangular opening 19 to be closed by the closure 3. The closure 3 is fixed along the one free side of one of the half side panels 5*a*, 5*b* to one of the side frames. As shown in FIG. 1 free side 7*a* of panel 5*a* is fixed to side frame 17*a*. The panels 5 are folded in zig-zag or accordion fashion about the hinges 1 to be stored adjacent the one side frame 17*a* when the closure 3 is opened to open opening 19. To close the opening 19, the panels 5 are unfolded, moving along track 13, to bring the free side 7*b* of the other half panel 5*b* adjacent the other side frame 17*b*. In this closed position, the panels 5 are almost aligned. Stop means are provided to prevent the panels from becoming aligned in order that the closure may be easily opened.

Figure 4:
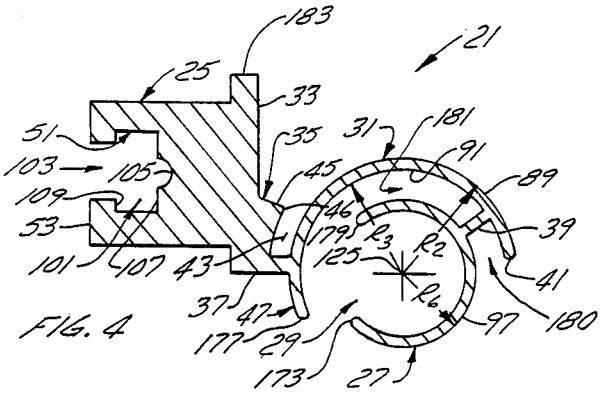
FIG. 4 is a cross-sectional view of one hinge member.

In more detail, each hinge 1, connecting two adjacent panels 5 together, comprises two elongated hinge members 21, 23. As seen in FIG. 4, the first hinge member 21 has a base portion 25 with a generally rectangular, cross-sectional shape. A curved guide 27 is spaced a short distance from the base portion 25.

The curved guide 27 comprises a thin-walled cylindrical element, extending generally parallel to the base portion and having a wide slot 29 therein extending the length of the element. The slot 29 has a width approximately equal to between one-third and one-quarter the circumference of the curved guide. The slot 29 generally faces the base portion 25. A first curved arm 31 extends from one end 33 of the base portion about one side of the pintle 27. The arm 31 is almost semi-cylindrical in shape and is concentric about the curved guide 27. One edge of the first arm 31 is attached to the one end 33 of the base portion 25 by a short, thick web 35. The web 35 is located adjacent one side 37 of the base portion 25. A short, thin web 39 connects the curved guide 27 to the first arm 31. The web 39 extends radially from the curved guide 27 and connects to the first curved arm 31 some distance inwardly from its free outer edge 41.

A curved slot 43 extends into the web 35 from its side 45 located opposite the one side 37 of the base portion 25.

If desired, the corner 46 defining one side of the entrance to the slot 43 can be rounded to minimize interference between it and any element entering the slot 43. A second curved arm 47 extends from the web 35 in an opposite direction of the first arm 31. The second arm 47 is relatively short and has the same curvature as the first arm 31 about the center of the curved guide 27.

Connecting means 51 are provided on the other edge 53 of the base portion 25 for use in connecting the first hinge member 21 to one long side 7 of a first closure panel 5 as will de described.

Figure 5:
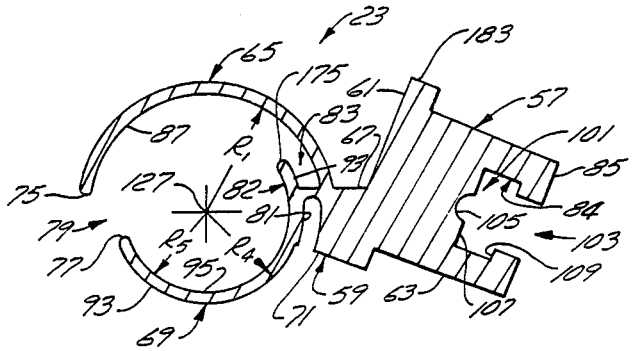
FIG. 5 is a cross-sectional view of the other hinge member.

The second hinge member 23, as seen in cross-section in FIG. 5, also has a base portion 57 with a generally rectangular cross-sectional shape. The base portion 57 is identical to the base portion 25 in the first hinge member 21. A short, thick web 59 extends outwardly from one end 61 of the base portion 25 adjacent one side 63 of the base portion 25. A third curved arm 65, generally semi-cylindrical in cross-sectional shape, is attached along one edge to one side 67 of the web 59. A fourth curved arm 69 extends from the other side 71 of the web 59. The fourth arm 69 is also part-cylindrical in cross-sectional shape and extends about 120 from the web 59. The arms 65, 69 curve toward each other and have the same center curvature although fourth arm 69 has a slightly smaller radius of curvature than third arm 65. The free edges 75, 77 of arms 65, 69 respectively have a relatively wide gap 79 between them. A curved slot 81 extends into the web 59 from side 71. The slot 81 has a length slightly longer than the length of the second curved arm 47 and is sized to receive arm 47 as will be described.

A short fifth curved arm 82 extends from the one side 67 of web 59. This fifth arm 82 is inside of third arm 65 and is concentric with it, forming a second short curved slot 83 in hinge member 23 opposite first slot 81 and facing in the opposite direction. The short curved fifth arm forms a continuation of fourth arm 69.

The base portion 57 has panel connecting means 84 on its opposite side 85 for use in connecting it to the long side 7 of an adjacent panel 5.

The radius R1 of the inside surface 87 of the third arm 65 is slightly greater than the radius R2 of the outside surface 89 of the first arm 31. The radius R3 of the inside surface 91 of the first arm 31 in turn is slightly greater than the radius R4 of the outside surface 93 of the fourth arm 69 and fifth arm 82. And the radius R5 of the inside surface 95 of the fourth arm 69 and fifth arm 82 is slightly greater than the radius R6 of the outside surface 97 of pintle 27.

The panel connecting means 51, 84 on each hinge member 21, 23 respectively can comprise a through hole 101 in the bases 25, 57, the hole 101 having a rectangular cross-sectional shape. A centrally located, longitudinal slot 103 in sides 53, 85 of the bases provides access to the hole 101. A part-cylindrical groove 105 is provided in the center of side 107 of rectangular hole 101 opposite the side 109 in which slot 103 opens, as shown in FIGS. 4 and 5.

Figure 6:
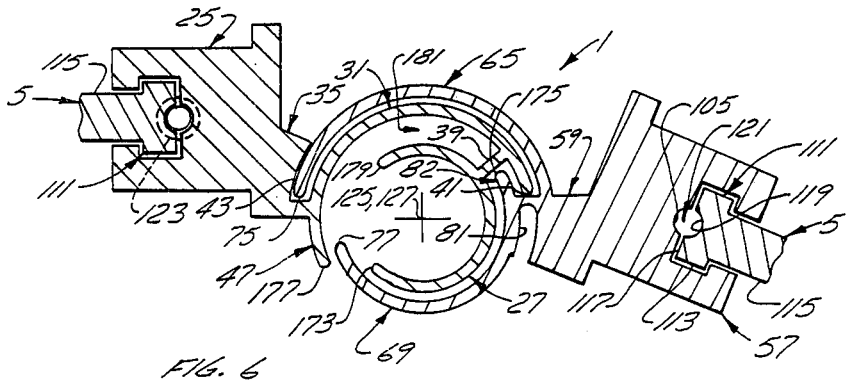
FIG. 6 is a cross-sectional view of the hinge with the closure closed.

Each panel 5 is formed with connecting means 111 on its sides 7 cooperating with the connecting means 51, 84 on the bases 25, 57 of the hinge members 21, 23 respectively. The panel connecting means 111, as shown in FIG. 6, comprises a rectangular bar 113 sized to substantially fill rectangular hole 101 with the web 115 of panel 5, attached perpendicular to, and centrally to, bar 113, sized to pass through slot 103. The side 117 of bar 113, opposite web 115, and facing side 107 of hole 101, has a part-cylindrical groove 119 mating with groove 105 to provide a circular hole 121.

One hinge member 21 is mounted on one side of each panel 5 and the other hinge member 24 is mounted on the other side of each panel 5. The hinge members 21, 23 are mounted on each panel by merely sliding each hinge member onto the connecting bar 113 at each side of the panel, the bars 113 passing into holes 101. After the hinge members 21, 23 have been mounted on the panel, a self-tapping screw 123 is threaded into hole 121 from each end to lock the hinge members to the panel as shown in FIG. 6.

The full panels 5, with one hinge member 21 fixed to one long panel side and with the other hinge member 23 fixed to the other long panel side, are now assembled by sliding the one hinge member 21 on one panel, within the other hinge member 23 on an adjacent panel. In more detail the hinge members 21, 23 are joined together, as shown in FIG. 6 by sliding the curved guide 27 of the first hinge member 21 between the third and fourth arms 65, 69. The center 125 of curved guide 27 corresponds to the center 127 of curvature of arms 65, 69 when the members 21, 23 are slidably inter-connected and in the unfolded position as shown in FIG. 6. The curved guide 27 lies adjacent the fourth arm 69 and also fifth arm 82. Fourth arm 69 in turn lies adjacent the second arm 47 and fifth arm 82 lies adjacent first arm 31. The first arm 31 in turn lies adjacent the third arm 65.

Figure 2:
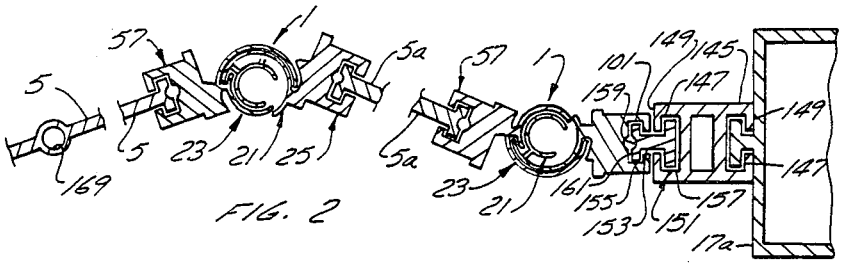
FIG. 2 is a cross-sectional view of the closure taken along line 2—2 of FIG. 1.

A self-tapping screw 141, carrying a washer 143 large enough to cover the outer arms 31, 65 of hinge members 21, 23 is now threaded into the bottom open end of curved guide 27 as shown in FIG. 1. The washer 143 supports the panel carrying hinge member 23 and the panel carrying the hinge member 21 to maintain adjacent panels together. The outer side of each outer half panel 5*a*, 5*b* is attached by a hinge 1 to a closure end member 145. Each end member 145, as shown in FIG. 2, can have a generally rectangular, hollow, cross-sectional shape. An inwardly directed T-slot 147 can be provided in the center on the narrow sides 149 of the member. A connector 151 is provided having a narrow panel 153 with a small rectangular cross-bar 155 at one end and a larger, rectangular, cross-bar 157 at the other end. Cross-bar 155 is similar to bar 113 on the sides of the full or half panels and has a part circular groove 159 in its outer side 161. The connector 151 is attached to hinge 1 by small cross-bar 155 sliding into hole 101, and to end member 145 by large cross-bar 157 sliding into T-slot 147. Connector 151 is fixed to end member 145 by suitable means, not shown, and can be held to hinge 1 by a self-tapping screw.

When all the full and half panels 5, 5*a*, 5*b* in the closure 5 have been connected together, each full panel 5 is then pivotably suspended from a trolley 11 at the center of its top edge 9 by a suitable pivot mounting pin 165. The pin 165 can be fixedly mounted at its lower end 167 within a cylindrical hole 169 formed in the center of each panel 5 between its sides 7 as shown in FIG. 3. The upper end 171 of pin 165 is rotatably mounted in trolley 11.

Figure 7:
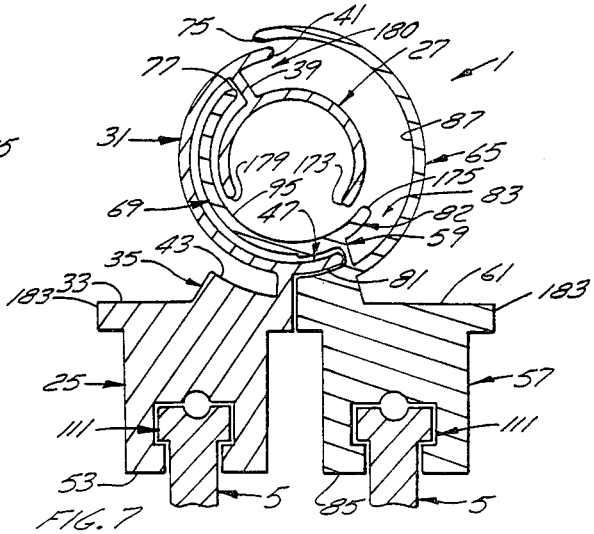
FIG. 7 is a cross-sectional view of the hinge with the closure opened.

When the closure 3 is unfolded to close opening 19, adjacent panels 5 pivot away from each other, from their parallel position shown in FIG. 7, about their common curved guide 27. In pivoting away from each other, the outer surface 89 of the first arm 31 of first hinge member 21 slides along the inner surface 87 of the third arm 65 of the second hinge member 23, and the inner surface 95 of the fourth arm 69 and fifth arm 82 slides over the outer surface 97 of the curved guide 27. At the beginning of the unfolding operation it will be seen, from FIG. 7, that the free end 41 of the first arm 31 is already past the free end section of third arm 65 and beneath it, and that the one free end 173 of curved guide 27 already is past the free end 175 of fifth arm 82 and overlaying it. Thus, when the closure begins to unfold, it does so smoothly since the arm 31 and curved guide 27 are already guided within encircling surfaces 87, 95 respectively. The unfolding movement continues through about 160 until the free edge 41 of the first arm 31 enters within slot 83 and abuts or nearly abuts web 59 on the second hinge member 23, and the free edge 75 of the third arm 65 slides into the slot 43 on the first hinge member 21. In this fully unfolded position, the second arm 47 just overlaps the free edge 77 of the fourth arm 69. The hinge members 21, 23 are prevented from moving 180 relative to each other about the pintle 27 in order that the closure may be easily folded up during opening. The arm 31, when it abuts on the web 59, and/or the arm 65, when it hits the bottom of slot 43, prevent the hinge members from moving 180 apart and becoming aligned. It will be seen that when the closure is fully opened, no gaps are visible in the hinges and the edge 75 of the third arm is not visible being inserted within slot 43 so as to provide a neat, clean appareance.

When the closure is folded up the panels 5 fold accordian-style with the fourth curved arm 69 of the hinge members 23 moving about the curved guide 27 and along the inside of first arm 31 until its free edge 77 abuts or nearly abuts the web 39. At the same time, the second arm 47 slides over the fourth curved arm 69. Since the free end 177 of second arm 47 initially overlies the end portion of fourth arm 69, there is no interference when the closure initially begins to fold up. If desired, the other free end 179 of the pintle could be turned slightly inwardly to further minimize the possibility of interference as this end approaches and slides past the free end 77 of fourth arm 69. The second arm 47 slides into slot 81 in web 59 and the third arm 31 moves back over the outside surface 89 of the first arm 31 until they just overlap. In the fully folded position, the one free end 173 of curved guide 27 lies just under the fifth arm 82. In the fully folded position the base portions 25, 57 of the hinge members 21, 23 lie side-by-side with their sides abutting as shown in FIG. 7. No gaps are visible in the hinges when the closure is folded.

It will be seen when the closure is unfolded, as shown in FIG. 6, that the ends 41, 75 of arms 31, 65 respectively, are in slots 85, 43 respectively. Arm 82 is also located within the first slot 180 formed by curved guide 27 and arm 31, this first slot 180 opening outwardly. When the closure is folded, as shown in FIG. 7, the end 77 of arm 69 enters the second slot 181 formed by curved guide 27 and arm 31, this second slot opening inwardly. End 177 of second arm 47 also enters slot 81. This internesting of the arms strengthens the hinge in both folded and unfolded positions against any forces tending to pull the members apart.

If desired, each base 25, 57 could be provided with shoulders 183 projecting from its sides at ends 33, 61 respectively so that these shoulders abut to slightly space the panels 5 from each other at the completion of opening, and thus provide clearance for the trolleys 11 to move adjacent each other.

Both the hinge members 21, 23 can be readily extruded from suitable material without difficult due to their novel construction. The relatively wide gap 79 between arms 65, 69 in hinge member 23 allows member 23 to be relatively inexpensively extruded since the extruding die does not require a narrow neck. The panels 5, connectors 151 and end members 145 can also be readily extruded from suitable material.

I claim:

1. A hinge having first and second elongated hinge members; the first hinge member having a base portion and a curved guide spaced from one side of the base portion; a long, curved, first arm extending from the one side of the base portion in one direction about the curved guide and concentric therewith; a web, spaced inwardly from the free end of the first arm, connecting the curved guide to the first arm; a short, curved second arm extending from the one side of the base in an opposite direction to the first arm; the second hinge member having a base portion with a long, curved, third arm extending from one side of the base portion in one direction and a long curved fourth arm extending from the one side in the opposite direction to the third arm; the third and fourth arms curving toward each other and having a gap between their free ends, the first and second hinge members adapted to slidably interconnect with the curved guide located within the fourth arm, the fourth arm located within the first and second arms, and the first arm located within the third arm; the arms having a length such that with the interconnected hinge members in a closed position, with the base portions located on the same side of the curved guide, the third arm slightly overlaps the first arm; and with the interconnected hinge members in an open position, with the base portions nearly aligned on opposite sides of the curved guide, the second arm slightly overlaps the fourth arm.

2. A hinge as claimed in claim 1 wherein the first hinge member includes means for hiding the free edge of the third curved arm when the interconnected hinge members are in the open position.

3. A hinge as claimed in claim 2 wherein the means for hiding the free edge of the third curved arm comprises a slot formed in one side of a web connecting the first and second arms to the base portion.

4. A hinge as claimed in claim 3 wherein the second hinge member includes a slot in the side of a web connecting the third and fourth arms to the base portion, the slot receiving the second arm when the interconnected hinge portions are in the closed position.

5. A hinge as claimed in claim 1 wherein the second hinge member includes a slot in the side of a web connecting the third and fourth arms to the base portions, the slot receiving the second arm when the interconnected hinge portions are in the closed position.

6. A hinge as claimed in claim 1 including a short, curved fifth arm on the second hinge member extending from a web connecting the third and fourth arms to the base portion, the fifth arm located inside the third arm and concentric with it, the fifth arm forming a continuation of the fourth arm and adapted to overlie one end of the curved guide when the members are in a closed position, and wherein the slot formed between the fifth and third arms receives the free end of the first arm when the members are in an open position.

7. A hinge having first and second elongated hinge members; the first hinge member having a base portion and a curved guide spaced from one side of the base portion; a relatively long, curved first arm extending from the one side of the base portion in one direction about the curved guide and concentric therewith; a web connecting the curved guide to the first arm; the second hinge member having a base portion with a relatively long, curved third arm extending from one side of the base portion in one direction and a relatively long, curved fourth arm extending from the one side of the base portion in the opposite direction to the third arm; the third and fourth arms curving toward each other and having a gap between their free ends; a relatively short, curved fifth arm on the second hinge member extending from the one side of the base portion in the said opposite direction, the fifth arm located within the third arm and aligned with the fourth arm; the first and second hinge members adapted to slidably interconnect with the curved guide located within the fourth and fifth arms, the fourth and fifth arms located within the first arm, and the first arm located within the third arm; the arms having a length such that with the interconnected hinge members in a closed position, and with the base portions located on the same side of the curved guide, the third arm just overlaps the first arm and the fifth arm just overlaps the curved guide.

8. A hinge as claimed in claim 7 including means on the first hinge member for hiding the free edge of the third curved arm when the interconnected hinge members are in the open position.

9. A hinge as claimed in claim 8 wherein the means for hiding the free edge of the third curved arm comprises a slot formed in one side of a web connecting the first arm to the base portion.

* * * * *